US011448172B2

(12) United States Patent
Lee et al.

(10) Patent No.: US 11,448,172 B2
(45) Date of Patent: Sep. 20, 2022

(54) RESONATOR

(71) Applicant: HS R & A Co., Ltd., Yangsan-si (KR)

(72) Inventors: Jong Sung Lee, Yangsan-si (KR); Guk Hyun Kim, Yangsan-si (KR); Jae Hyeok Choi, Yangsan-si (KR)

(73) Assignee: HS R & A Co., Ltd., Yangsan-si (KR)

( * ) Notice: Subject to any disclaimer, the term of this patent is extended or adjusted under 35 U.S.C. 154(b) by 156 days.

(21) Appl. No.: 16/774,730

(22) Filed: Jan. 28, 2020

(65) Prior Publication Data

US 2020/0408178 A1 Dec. 31, 2020

(30) Foreign Application Priority Data

Jun. 26, 2019 (KR) ..... 10-2019-0076315

(51) Int. Cl.
*F02M 35/12* (2006.01)
*F02M 35/10* (2006.01)

(52) U.S. Cl.
CPC .. *F02M 35/1255* (2013.01); *F02M 35/10091* (2013.01); *F02M 35/10209* (2013.01); *F02M 35/1216* (2013.01); *F02M 35/1288* (2013.01)

(58) Field of Classification Search
CPC ..... F02M 35/10091; F02M 35/10209; F02M 35/10354; F02M 35/1216; F02M 35/1255; F02M 35/1261; F02M 35/1266; F02M 35/1283; F02M 35/1288; F01N 1/02; F01N 1/026; F01N 1/04
See application file for complete search history.

(56) References Cited

U.S. PATENT DOCUMENTS

2016/0201621 A1* 7/2016 Grieswald ..... F16L 55/033 181/229
2018/0245553 A1* 8/2018 Lee ..... F02M 35/1255

* cited by examiner

*Primary Examiner* — Grant Moubry
*Assistant Examiner* — Ruben Picon-Feliciano
(74) *Attorney, Agent, or Firm* — Novick, Kim & Lee, PLLC; Jae Youn Kim; Jihun Kim

(57) ABSTRACT

A resonator includes: an inner pipe having first openings penetrated into an outer peripheral surface thereof from an inner peripheral surface thereof and second openings spaced apart from the first opening; a first cover adapted to allow a first resonant space to be formed between the outer peripheral surface of the inner pipe and the inner peripheral surface thereof, the first resonant space communicating with the internal space of the inner pipe through the first openings; and a second cover adapted to allow a second resonant space to be formed between the outer peripheral surface of the inner pipe and the inner peripheral surface thereof, the second resonant space communicating with the internal space of the inner pipe through the second openings.

6 Claims, 11 Drawing Sheets

RESONATOR

CROSS REFERENCE TO RELATED APPLICATION OF THE INVENTION

The present application claims the benefit of Korean Patent Application No. 10-2019-0076315 filed in the Korean Intellectual Property Office on Jun. 26, 2019, the entire contents of which are incorporated herein by reference.

BACKGROUND OF THE INVENTION

Field of the Invention

The present invention relates to a resonator, and more particularly, to a resonator that is capable of providing a variety of resonant frequencies.

Background of the Related Art

Silence in an interior of a vehicle becomes a scale for determining a value of the vehicle. Accordingly, a customer's demand for noise vibration harshness (NVH) performance has been increased, but a space of an engine room, to which additional specifications are applied, becomes small.

Particularly, noise generated from an explosion component of an engine has a great influence on the interior of the vehicle. During the vehicle is acceleratedly driven, the engine noise generated at a specific RPM region has a specific frequency and is transmitted to the interior of the vehicle through an intake duct.

While the vehicle is being driven, generally, external air is passed through a radiator and is thus introduced into the engine room. An air cleaner is located at one side corner of the engine room of the vehicle, and the air cleaner serves to prevent dust in the air passing through the radiator from entering the engine. The air cleaner communicates with an air duct for sucking the air.

The air cleaner is connected to the engine through the air duct. The air enters the engine through the air duct at a speed in a range from 7 to 8 m per second. If the air is passed through the air duct and a bent path of the engine at such a speed, suction noise may be generated. So as to reduce the suction noise, a resonator like a bag is attached to the air duct.

The intake noise of the engine has different frequencies according to the RPM of the engine, and accordingly, the intake noise is generated with a plurality of specific frequencies over several RPM bands. So as to remove the noise of the engine, a resonator for controlling the frequencies is used in almost all kinds of vehicles, but it is very hard to effectively reduce and control the intake noise with one resonator. Further, it is difficult to use two or more resonators when considering the internal space of the engine room and the manufacturing cost thereof.

A noise reduction effect depends on a structure of the resonator. A resonator fixed in structure has the most excellent noise reduction effect with respect to the noise at specific frequencies. A structure of the resonator is desirably designed to effectively reduce the noise generated from the frequencies giving the greatest influences on the intake noise of the engine.

In detail, a maximum noise reduction effect frequency of the resonator is determined according to three control factors like a volume, a neck length, and a neck area, and in conventional practices, since the resonator makes use of only one neck, there are limitations in controlling frequencies in a wide band from a low frequency region to a high frequency region through the control of the frequencies depending on the changes only in the volume of the resonator.

So as to control the noise in the wide frequency band only with the changes in the volume of the resonator, further, a substantially large volume has to be basically ensured, which causes limitations in space and manufacturing cost.

Accordingly, there is a need for a resonator capable of requiring no large installation space through a compact structure and effectively handling noise generated at various frequencies.

SUMMARY OF THE INVENTION

Accordingly, the present invention has been made in view of the above-mentioned problems occurring in the related art, and it is an object of the present invention to provide a resonator that is capable of providing a plurality of peak resonant frequencies in a wide band.

To accomplish the above-mentioned object, according to the present invention, there is provided a resonator mounted on an intake system for supplying air to an engine of a vehicle to allow a given frequency in intake noise to be resonated to reduce the intake noise, the resonator including: an inner pipe formed to a shape of a cylinder with an inner peripheral surface forming an internal space and an outer peripheral surface and having first openings penetrated into the outer peripheral surface thereof from the inner peripheral surface thereof and second openings spaced apart from the first opening; a first cover coupled to the outer peripheral surface of the inner pipe in such a manner as to allow a first resonant space to be formed between the outer peripheral surface of the inner pipe and the inner peripheral surface thereof, the first resonant space communicating with the internal space of the inner pipe through the first openings and a volume of the first resonant space being set to reduce a first frequency; and a second cover coupled to the outer peripheral surface of the inner pipe in such a manner as to allow a second resonant space to be formed between the outer peripheral surface of the inner pipe and the inner peripheral surface thereof, the second resonant space communicating with the internal space of the inner pipe through the second openings, and a volume of the second resonant space being set to reduce a second frequency.

According to the present invention, desirably, one side peripheral end of the inner pipe communicates with a first pipe of the intake system for introducing external air, the other side peripheral end thereof communicates with a second pipe for supplying the air to the engine, and the first cover and the second cover are formed of loop-shaped members adapted to insert the inner pipe.

According to the present invention, desirably, the first cover and the second cover are connected unitarily with each other along the outer peripheral surface of the inner pipe in a circumferential direction of the inner pipe in such a manner as to have a shape of a loop, and the first cover and the second cover are divided by means of partition walls.

According to the present invention, desirably, the first openings and the second openings have a shape of a slit extended in the circumferential direction of the inner pipe, and the first openings and the second openings are formed to allow at least one of the number of openings, the lengths of openings in the circumferential direction of the inner pipe, the widths and number of openings in a longitudinal direction of the inner pipe to be different from each other.

According to the present invention, desirably, the resonator further includes a third cover spaced apart from the second cover in the longitudinal direction of the inner pipe and coupled to the outer peripheral surface of the inner pipe in such a manner as to allow a third resonant space to be formed between the outer peripheral surface of the inner pipe and the inner peripheral surface thereof, the third resonant space communicating with the internal space of the inner pipe through third openings formed on the inner pipe, and a volume of the third resonant space being set to reduce a third frequency.

According to the present invention, desirably, the first cover, the second cover, and the third cover are detachably coupled to the inner pipe, individually.

According to the present invention, desirably, the inner pipe includes: a first pipe part insertedly fitted to the first cover; a second pipe part insertedly fitted to the second cover; and a third pipe part insertedly fitted to the third cover.

BRIEF DESCRIPTION OF THE DRAWINGS

The above and other objects, features and advantages of the present invention will be apparent from the following detailed description of the embodiments of the invention in conjunction with the accompanying drawings, in which.

DETAILED DESCRIPTION OF THE EMBODIMENTS

Figure 1:
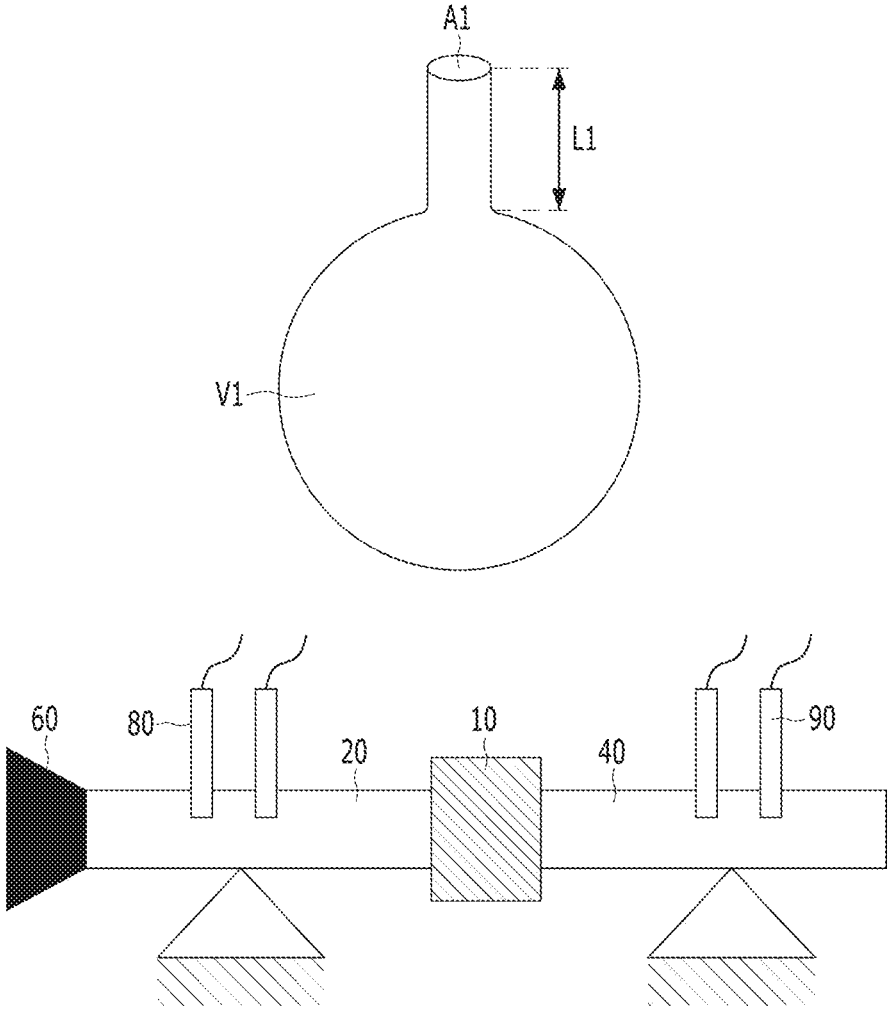
FIG. 1 is an exemplary view showing an apparatus for testing an effect of reducing noise of a specific frequency through resonance.

Hereinafter, the present invention will be explained with reference to the attached drawings. Before the present invention is disclosed and described, it is to be understood that the disclosed embodiments are merely exemplary of the invention, which can be embodied in various forms. In the drawings, portions having no relation with the explanation will be avoided for the brevity of the description, and the corresponding parts in the embodiments of the present invention are indicated by corresponding reference numerals.

In the description, when it is said that one element is described as being "connected", "connected", or "coupled" to the other element, one element may be directly connected or coupled to the other element, but it should be understood that another element may be present between the two elements. Also, when it is said that one portion is described as "includes" any component, one element further may include other components unless no specific description is suggested.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

Hereinafter, an explanation on a resonator according to the present invention will be in detail given with reference to the attached drawings.

FIG. 1 is an exemplary view showing an apparatus for testing an effect of reducing noise of a specific frequency through resonance.

An effect of reducing noise of a specific frequency through the resonance of a resonator 10 is determined according to a structure of the resonator 10. For example, as conceptually shown on an upper side of FIG. 1, a maximum noise reduction effect frequency of the resonator 10 is determined as the following equation 1 with three control factors like volume V1, neck length L1, and hole area A1.

$$f = \frac{c\sqrt{\frac{A}{VL}}}{2\pi} \qquad \text{Equation 1}$$

The volume V1 of a resonant space, the neck length L1, and the hole area A1 of the neck are varied to tune a resonant frequency, that is, the maximum noise reduction effect frequency.

For example, the resonant frequency of the resonator 10 can be tested through an apparatus as shown on a lower side of FIG. 1.

In detail, a first pipe 20 and a second pipe 40 are connected to an inlet and an outlet of the resonator 10, and a sound source 60 is located on the end of the first pipe 20. Further, sensors 80 and 90 are disposed on the first pipe 20 located on the inlet side of the resonator 10 and on the second pipe 40 located on the outlet side of the resonator 10 to measure a difference in sound power between the inlet and the outlet of the resonator 10.

In this case, a transmission loss TL can be obtained from the difference in sound power, and for example, accordingly, a relation between the structure of the resonator 10, that is, the volume of a resonant space, the neck length, and the hole area of the neck and a resonant frequency with the largest transmission loss can be checked.

Accordingly, the structure of the resonator 10 can be designed to have a given target frequency.

Figure 2A:
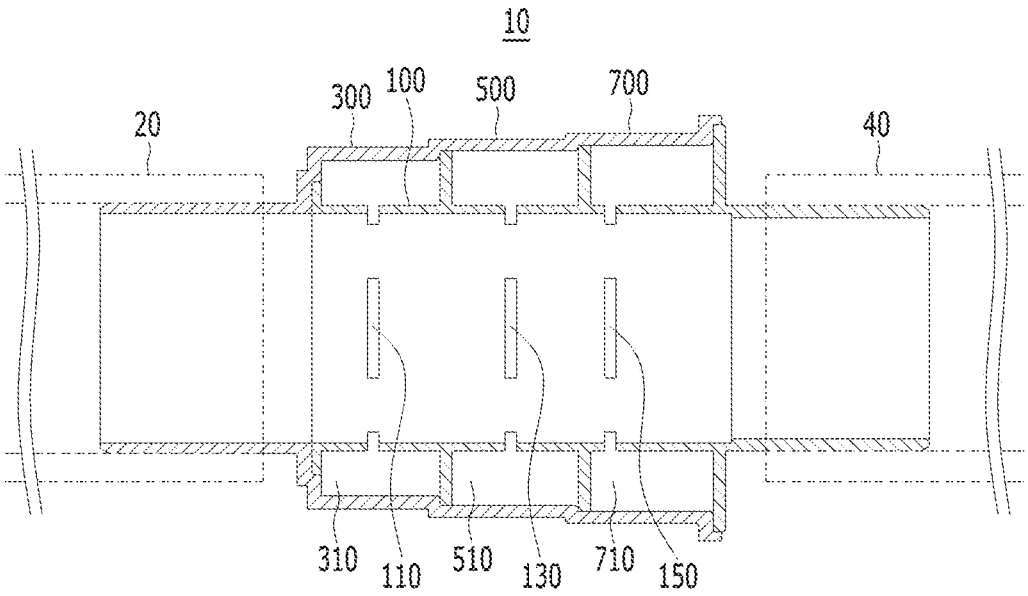
FIGS. 2A and 2B are sectional views showing resonators according to first and second embodiments of the present invention.
Figure 2B:
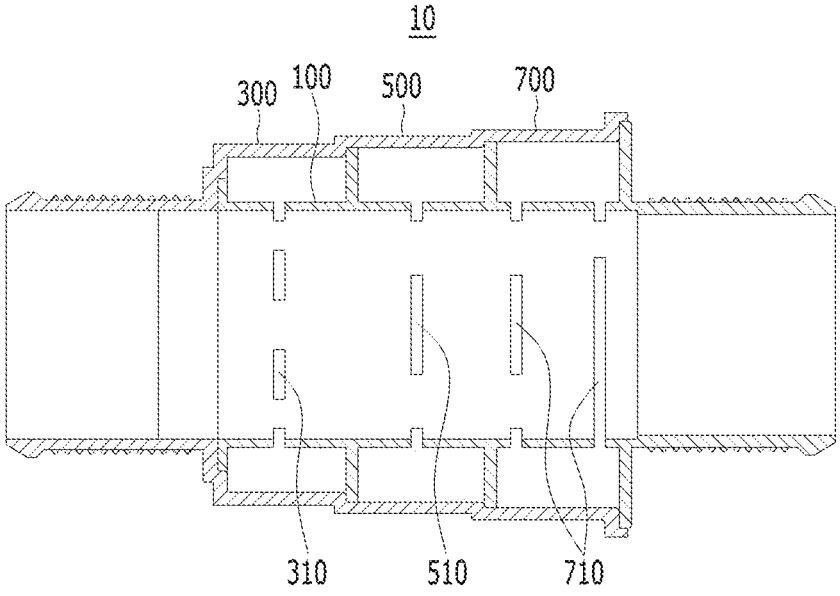

FIGS. 2A and 2B show resonators 10 according to first and second embodiments of the present invention.

According to the present invention, the resonator 10 is mounted on an intake system for supplying air to an engine of a vehicle to allow a given frequency in intake noise to be resonated to reduce the intake noise.

The resonator 10 includes an inner pipe 100, a first cover 300, a second cover 500, and a third cover 700.

The inner pipe 100 is adapted to pass noise therethrough and has a shape of a cylinder with an inner peripheral surface forming an internal space and an outer peripheral surface. As shown in FIG. 2A, one side peripheral end of the inner pipe 100 communicates with the first pipe 20 of the intake system for introducing external air, and the other side peripheral end thereof communicates with the second pipe 40 for supplying the air to the engine. Of course, the inner pipe 100 may become one pipe of the intake system.

The inner pipe 100 includes first openings 110, second openings 130, and third openings 150, which are penetrated into the outer peripheral surface thereof from the inner peripheral surface thereof.

The first openings 110, the second openings 130, and the third openings 150 are spaced apart from each other in a longitudinal direction of the inner pipe 100. The first openings 110, the second openings 130, and the third openings 150 correspond to the neck of the resonator 10 as explained in FIG. 1. In detail, the resonant frequency may be varied according to sizes or shapes of the first openings 110, the second openings 130, and the third openings 150.

The first openings 110, the second openings 130, and the third openings 150 have a shape of a slit extended in a circumferential direction of the inner pipe 100. In detail, one or more first openings 110 may be formed at given positions of the inner pipe 100 to a shape of a slit in the circumferential direction of the inner pipe 100. Also, one or more second and third openings 130 and 150 may be formed in the circumferential direction of the inner pipe 100, while being different in positions from each other in the longitudinal direction of the inner pipe 100.

As shown in FIG. 2B, the first openings 110 and the second openings 130 are formed to allow at least one of the number of openings, the lengths of the openings in the circumferential direction of the inner pipe 100, and the widths of the openings in the longitudinal direction of the inner pipe 100 to be different from each other. Accordingly, noise reduction effects for various resonant frequencies, which will be discussed later, can be obtained.

The first cover 300, the second cover 500, and the third cover 700 are formed of a loop-shaped member adapted to insert the inner pipe 100. In detail, the first cover 300, the second cover 500, and the third cover 700 are coupled to the outer peripheral surface of the inner pipe 100.

The first cover 300, the second cover 500, and the third cover 700 may be individual members. According the present invention, however, the first cover 300, the second cover 500, and the third cover 700 are integrally connected in series with each other, as shown in FIGS. 2A and 2B.

One side peripheral end of the first cover 300 is extended and fastened to the first pipe 20 by means of screw threads formed on one side peripheral end of the first cover 300 and the first pipe 20. One side peripheral end of the inner pipe 100 is insertedly fitted to the inner peripheral surface of the first cover 300 in such a manner as to communicate with the first pipe 20 of the intake system.

The first cover 300 is located correspondingly to the first openings 110, the second cover 500 to the second openings 130, and the third cover 700 to the third openings 150.

As shown in FIG. 2B, the circumferential lengths, number, and longitudinal widths of the first openings 110, the second openings 130, and the third openings 150 are different from each other according to noise reduction target frequencies, that is, resonant frequencies.

The first cover 300 is coupled to the outer peripheral surface of the inner pipe 100 to form a first resonant space 310 between the outer peripheral surface of the inner pipe 100 and the inner peripheral surface thereof. The first resonant space 310 can communicate with the internal space of the inner pipe 100 through the first openings 110. A volume of the first resonant space 310 is selected correspondingly to a resonant frequency at a first frequency.

The second cover 500 is coupled to the outer peripheral surface of the inner pipe 100 to form a second resonant space 510 between the outer peripheral surface of the inner pipe 100 and the inner peripheral surface thereof. The second resonant space 510 can communicate with the internal space of the inner pipe 100 through the second openings 130. A volume of the second resonant space 510 is selected correspondingly to a resonant frequency at a second frequency.

The third cover 700 is coupled to the outer peripheral surface of the inner pipe 100 to form a third resonant space 710 between the outer peripheral surface of the inner pipe 100 and the inner peripheral surface thereof. The third resonant space 710 can communicate with the internal space of the inner pipe 100 through the third openings 150. A volume of the third resonant space 710 is selected correspondingly to a resonant frequency at a third frequency.

The first resonant space 310, the second resonant space 510, and the third resonant space 710 correspond to the volume as conceptually explained in FIG. 1. The first resonant space 310, the second resonant space 510, and the third resonant space 710 can be varied by adjusting the diameters and longitudinal widths of the first cover 300, the second cover 500, and the third cover 700.

The lengths, number, and widths of the first openings 110, the second openings 130, and the third openings 150 and the volumes of the first resonant space 310, the second resonant space 510, and the third resonant space 710 can be designed correspondingly to the target resonant frequencies. So as to add the resonant frequencies, of course, fourth openings 170 and a fourth cover 900 as will be discussed later may be further provided in simple structure, so that the structure of the resonator 10 can be easily changed according to the noise reduction target frequencies.

According to the present invention, therefore, the resonator 10 is configured to have the first cover 300, the second cover 500, and the third cover 700 disposed compactedly to easily form their respective resonant spaces, and further, it is easy to adjust the shapes of the first to third openings and the volumes of the first to third resonant spaces. As a result, the noise reduction effect can be obtained in a desired frequency band, that is, in a wide range from a low frequency region to a high frequency region, thereby allowing the resonator 10 to be efficiently located in a limited space like the engine room.

Figure 3A:
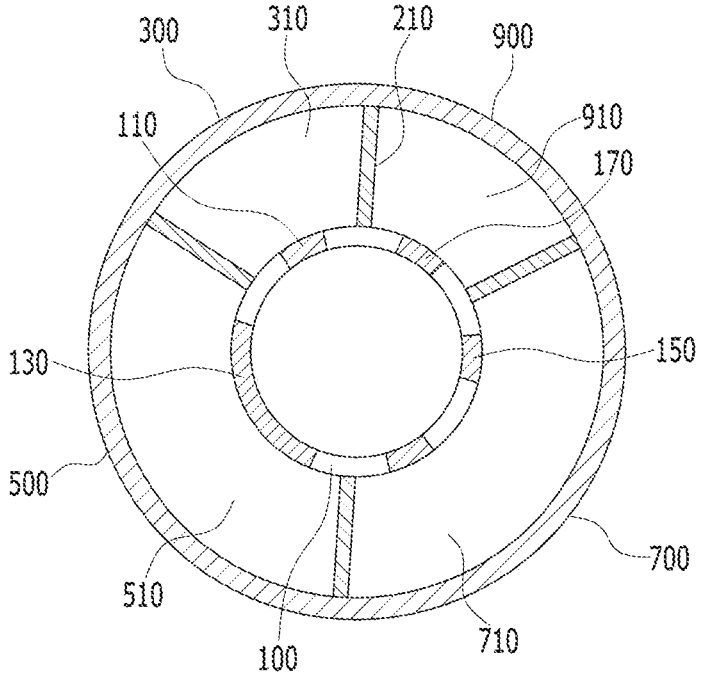
FIGS. 3A and 3B are top views showing resonators according to third and fourth embodiments of the present invention.
Figure 3B:
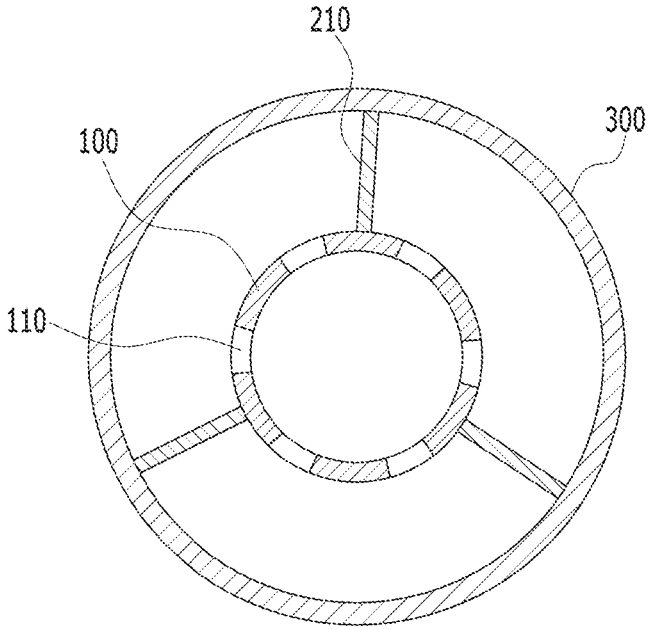

FIGS. 3A and 3B show resonators 10 according to third and fourth embodiments of the present invention.

As shown in FIG. 3A, the resonator 10 includes an inner pipe 100, a first cover 300, a second cover 500, a third cover 700, and a fourth cover 900.

The inner pipe 100 is adapted to pass noise therethrough and has a shape of a cylinder with an inner peripheral surface forming an internal space and an outer peripheral surface.

One side peripheral end of the inner pipe 100 communicates with the first pipe of the intake system for introducing external air, and the other side peripheral end thereof communicates with the second pipe for supplying the air to the engine.

The first cover 300, the second cover 500, the third cover 700, and the fourth cover 900 are connected unitarily with each other along the outer peripheral surface of the inner pipe 100 in a circumferential direction of the inner pipe 100 in such a manner as to have a shape of a loop. In detail, the first cover 300, the second cover 500, the third cover 700, and the fourth cover 900 are formed unitarily with each other into one loop-shaped member.

A space between the first cover 300, the second cover 500, the third cover 700, and the fourth cover 900 and the outer peripheral surface of the inner pipe 100 is divided into a first resonant space 310, a second resonant space 510, a third resonant space 710, and a fourth resonant space 910 by means of partition walls 210. The partition walls 210 are extended in a radial direction from the inner pipe 100 or extended from the inner peripherals surfaces of the first cover 300, the second cover 500, the third cover 700, and the fourth cover 900.

First openings 110, second openings 130, third openings 150, and fourth openings 170 are formed on the inner pipe 100. The first openings 110, the second openings 130, the third openings 150, and the fourth openings 170 have a shape of a slit extended in a circumferential direction of the inner pipe 100, and they are formed to allow the lengths and number of openings and the number of openings in a longitudinal direction of the inner pipe 100 to be different from each other. Accordingly, the resonant frequencies of the first resonant space 310, the second resonant space 510, the third resonant space 710, and the fourth resonant space 910 may be different from each other.

The lengths and number of the respective openings and the number of openings in the longitudinal direction of the inner pipe 100 are designed appropriately to the target resonant frequencies, and the positions of the partition walls 210 are changed to adjust the volumes of the first resonant space 310, the second resonant space 510, the third resonant space 710, and the fourth resonant space 910. The positions of the partition walls 210 can be changed in such a manner as to be slidably coupled to the outer peripheral surface of the inner pipe 100 or to the inner peripheral surfaces of the respective covers.

Accordingly, the resonator 10 according to the present invention is very compact in structure and has the plurality of resonant spaces whose resonant frequencies are easily changed, so that the resonator 10 can be customized to the resonant frequencies as required and can cover a large frequency band.

On the other hand, as shown in FIG. 3B, a resonator 10 according to a fourth embodiment of the present invention has characteristics combined with the resonator 10 as shown in FIGS. 2A and 2B and the resonator 10 as shown in FIG. 3A.

In detail, the resonator 10 as shown in FIG. 3B includes an inner pipe 100, a first cover 300, a second cover 500, and a third cover 700. Their coupling relation is the same as in FIGS. 2A and 2B. On the other hand, at least one of a first resonant space 310, a second resonant space 510, and a third resonant space 710 formed by the first cover 300, the second cover 500, and the third cover 700 is divided into sub-divided resonant spaces by means of partition walls 210. The sub-divided resonant spaces communicate with the internal space of the inner pipe 100 by means of the openings formed on the inner pipe 100.

According to the fourth embodiment of the present invention, therefore, the resonator 10 is configured to have the respective resonant spaces formed compactedly in the longitudinal direction of the inner pipe 100 in such a manner as to be easily changeable and to have the plurality of sub-divided resonant spaces formed compactedly in the circumferential direction of the inner pipe 100 in such a manner as to be easily changeable, thereby providing resonant frequencies for various frequencies in a wide band.

Hereinafter, an explanation on a maximum transmission loss frequency, that is, resonant frequency according to the structure of the resonator 10 will be given further.

Figure 4A:
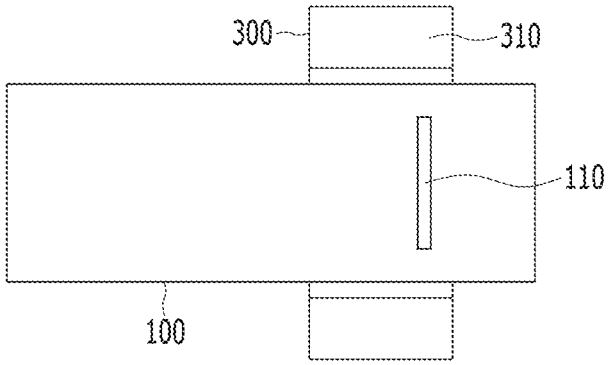
FIGS. 4A to 4C show examples where relations between changes in the number of openings and the widths of the openings and peak frequencies in transmission losses are tested.
Figure 4B:
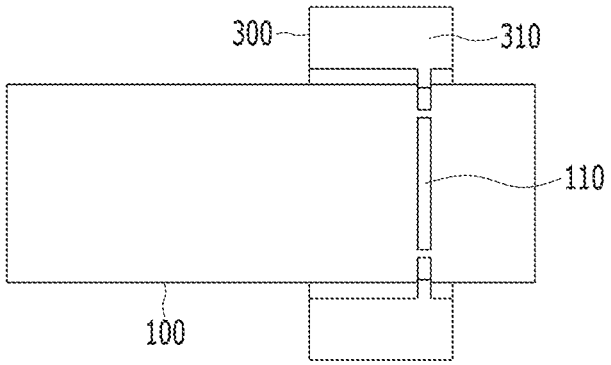
Figure 4C:
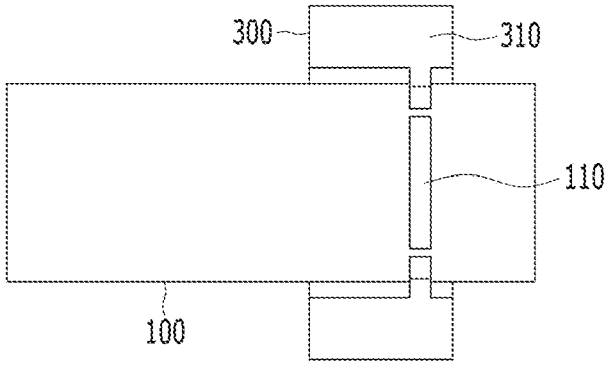
Figure 5A:
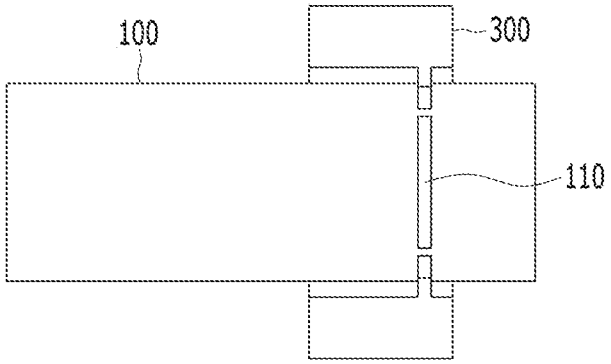
FIGS. 5A to 5C show examples where relations between changes in the number of openings in one resonant space and peak frequencies in transmission losses are tested.
Figure 5B:
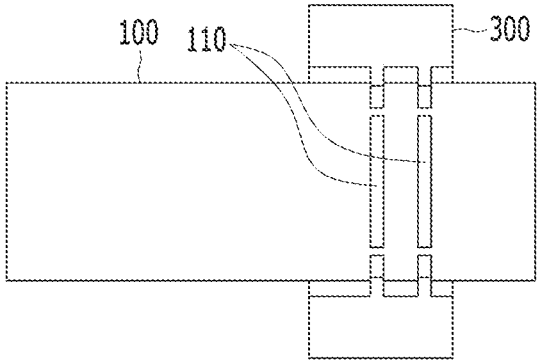
Figure 5C:
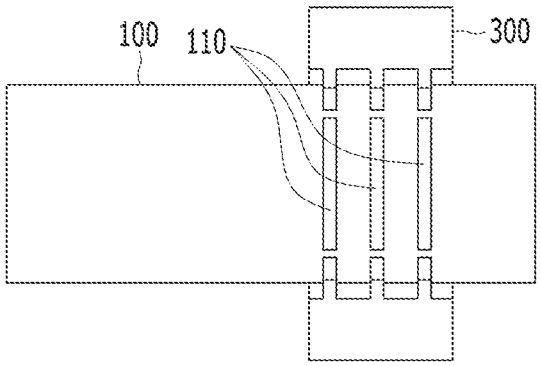
Figure 6A:
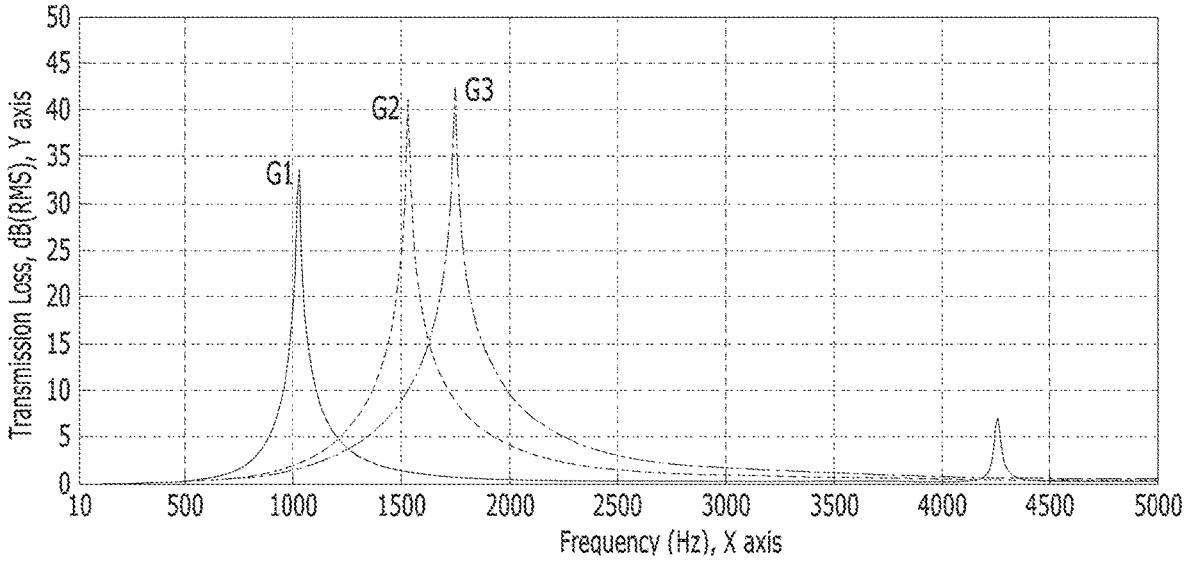
FIGS. 6A and 6B are graphs showing the test results of FIGS. 4A to 4C and FIGS. 5A to 5C.
Figure 6B:
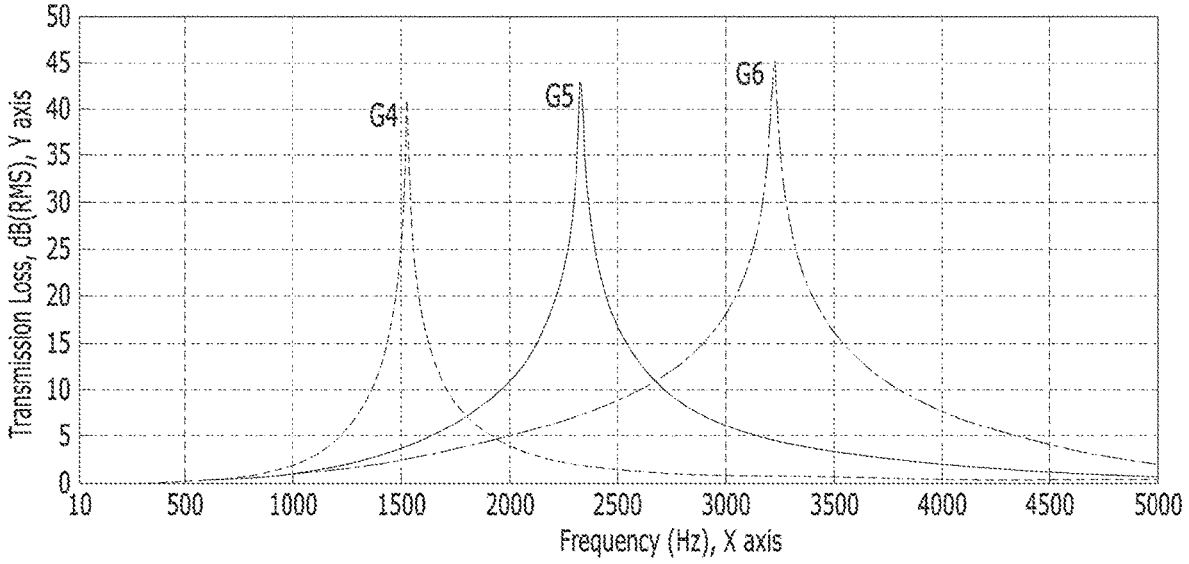

FIGS. 4A to 4C show examples where relations between changes in the number of openings and the widths of the openings and peak frequencies in transmission losses are tested. FIGS. 5A to 5C show examples where relations between changes in the number of openings in one resonant space and peak frequencies in transmission losses are tested. FIGS. 6A and 6B are graphs showing the test results of FIGS. 4A to 4C and FIGS. 5A to 5C.

As mentioned above, the respective openings have a shape of a slit extended in the circumferential direction of the inner pipe 100, and also, they are formed to allow at least one of the number of openings, the circumferential opening lengths, and the opening widths in the longitudinal direction of the inner pipe 100 to be different from each other.

For example, the number or lengths of first openings 110 in the circumferential direction of the inner pipe 100 as shown in FIG. 4B is more increased than that as shown in FIG. 4A, and also, the widths of the first openings 110 in the longitudinal direction of the inner pipe 100 as shown in FIG. 4C is more increased than that as shown in FIG. 4B.

Through the test for measuring the resonant frequency, as shown in FIG. 6A, it can be checked that if the widths of the openings or the lengths and number of openings are increased, the resonant frequencies are remarkably increased.

A horizontal axis in FIGS. 6A and 6B indicates frequencies of noise transmitted and a vertical axis indicates the transmission losses. Graphs G1, G2 and G3 of FIG. 6A indicate maximum transmission loss frequencies, that is, resonant frequencies in FIGS. 4A to 4C.

Referring to the graph G1, for example, the resonator 10 as shown in FIG. 4A has a maximum value in the transmission losses at a frequency of about 1,000 Hz, and accordingly, the resonant frequency is 1,000 Hz. Other graphs may be analyzed in the same manner as above.

Further, as shown in FIGS. 5A to 5C, it can be checked that if the number of first openings 110 corresponding to one resonant space is increased in the longitudinal direction of the inner pipe 100, the resonant frequencies have been more increased.

Graphs G4, G5 and G6 of FIG. 6B indicate maximum transmission loss frequencies, that is, resonant frequencies in FIGS. 5A to 5C.

In detail, the resonant frequencies for the high frequency region can be formed, thereby achieving noise reduction in the high frequency region. Also, it can be checked that the resonator 10 can handle noise in a low frequency region through the change of the openings.

Figure 7A:
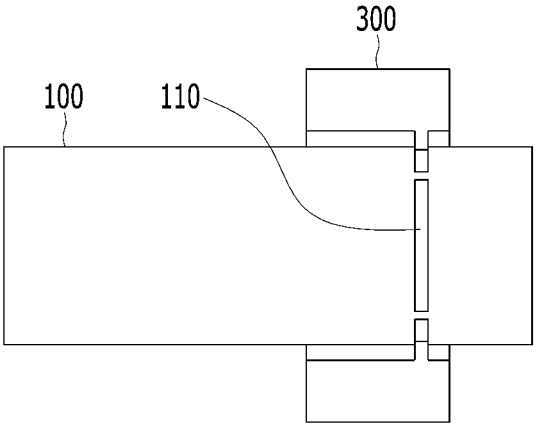
FIGS. 7A to 7C show examples where relations between changes in the number of resonant spaces and peak frequencies in transmission losses are tested.
Figure 7B:
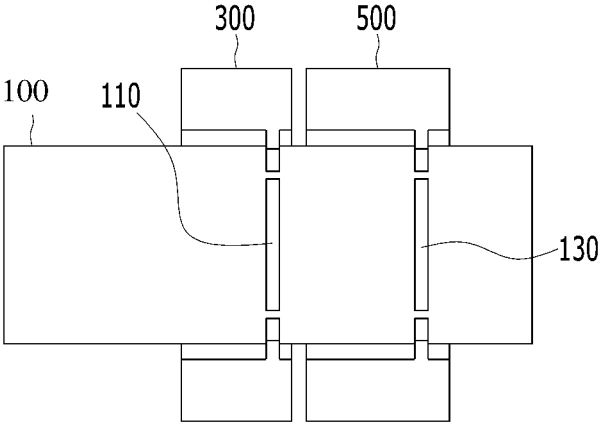
Figure 7C:
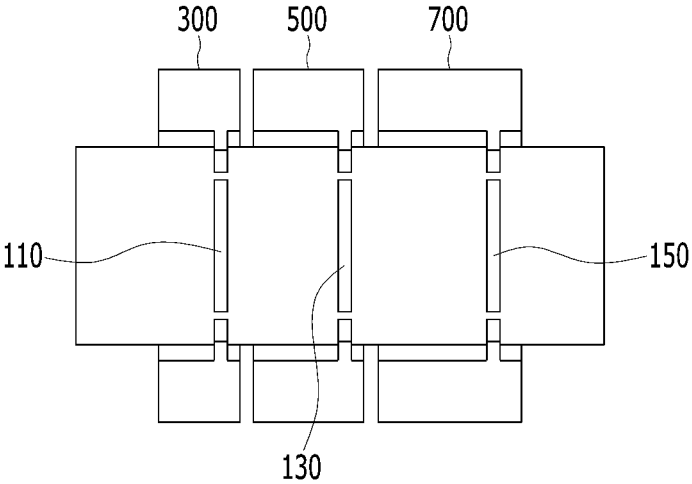
Figure 8A:
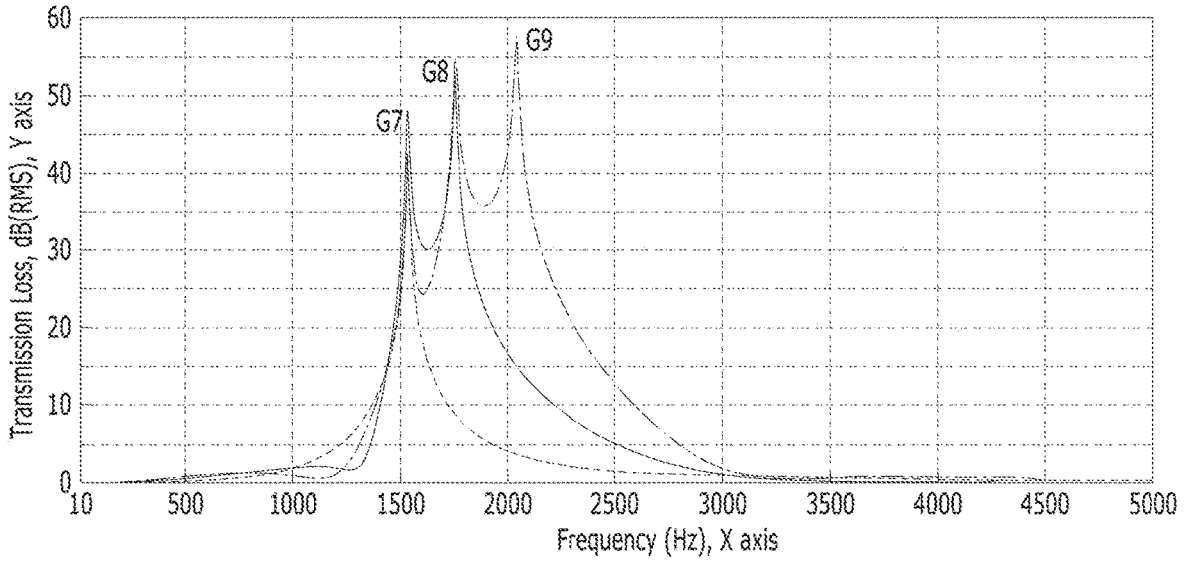
FIGS. 8A and 8B are graphs showing the test results of FIGS. 7A to 7C and FIGS. 2A and 2B.
Figure 8B:
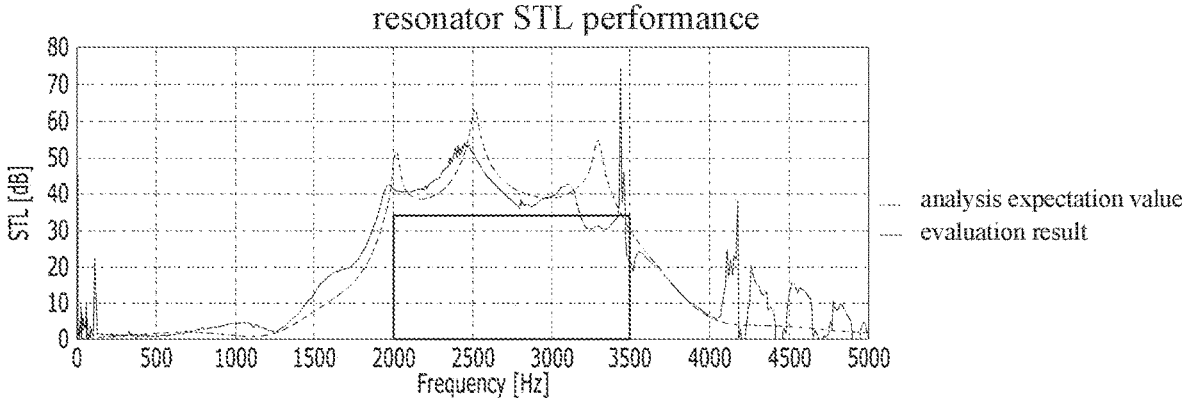

FIGS. 7A to 7C show examples where relations between changes in the number of resonant spaces and peak frequencies in transmission losses are tested. FIGS. 8A and 8B are graphs showing the test results of FIGS. 7A to 7C and FIGS. 2A and 2B.

As mentioned above, the respective openings have a shape of a slit extended in the circumferential direction of the inner pipe 100, and also, they are formed to allow at least one of the number of openings, the circumferential opening lengths, and the longitudinal opening widths to be different from each other.

As mentioned above, further, the different resonant spaces are formed plurally correspondingly to the target resonant frequencies as required. For example, as shown in FIGS. 7A to 7C, even if the openings have the same shapes as each other, the sizes of the first to third covers 300, 500 and 700 are different from each other so that the respective resonant spaces are differently formed.

Graphs G7, G8 and G9 of FIG. 8A indicate test results of FIGS. 7A to 7C. In detail, the resonant frequencies corresponding to the respective resonant spaces are formed, and it can be checked that as the resonant spaces become large, the resonant frequencies at a high frequency are formed.

As shown in FIGS. 4A to 8A, the resonant frequencies as required can be obtained through the changes in the shapes of the openings and the sizes of the resonant spaces of the resonator 10.

The test result of FIGS. 2A and 2B is shown in FIG. 8B. Referring to FIG. 8B, it can be checked that an analysis expectation value and the test result (evaluation result) are very similar to each other and several resonant frequencies (a plurality of peaks) are formed over a wide band.

Figure 9A:
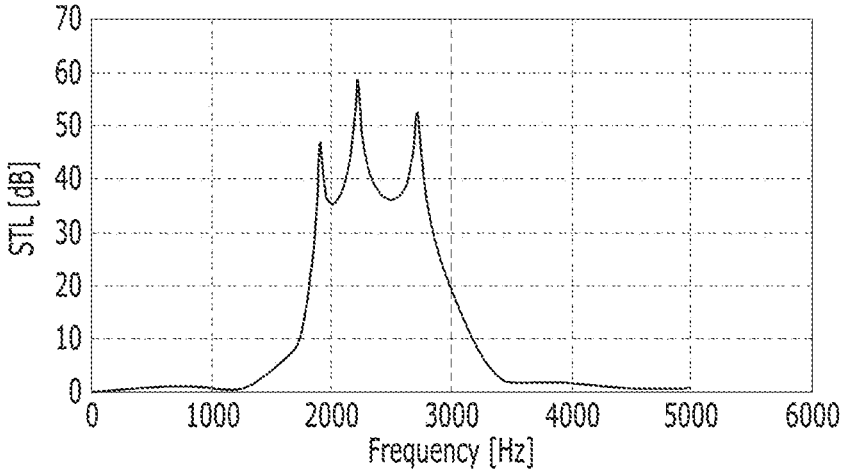
FIGS. 9A and 9B are graphs showing the test results of FIGS. 3A and 3B.
Figure 9B:
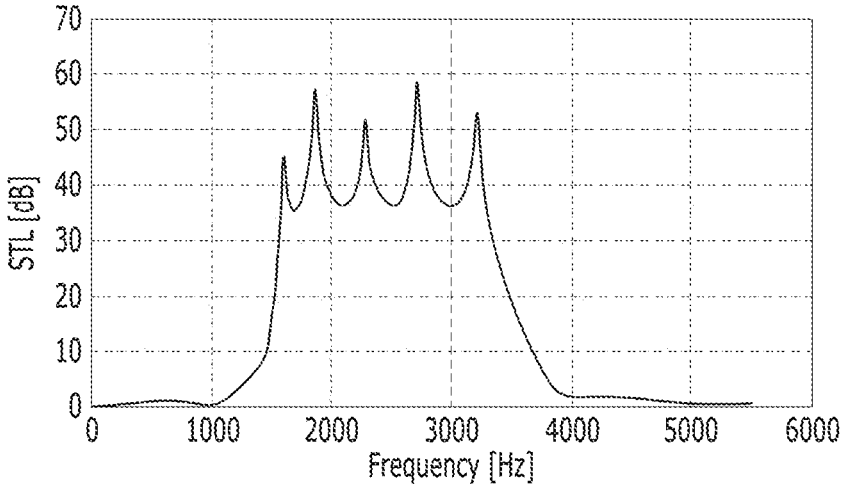

FIGS. 9A and 9B are graphs showing the test results of FIGS. 3A and 3B.

As mentioned above, the first to fourth covers 300, 500, 700, and 900 are connected with each other in the circumferential direction of the inner pipe 100 to form one loop-shaped member, and the resonant spaces formed by the respective covers are divided by means of the partition walls 210.

It can be appreciated that a graph as shown in FIG. 9B has a larger number of peaks than that as shown in FIG. 9A. The number of partition walls 210 as shown in FIG. 9B is larger than that as shown in FIG. 9A so that the number of sub-divided resonant spaces divided in the circumferential direction of the inner pipe 100 is increased.

Figure 10A:
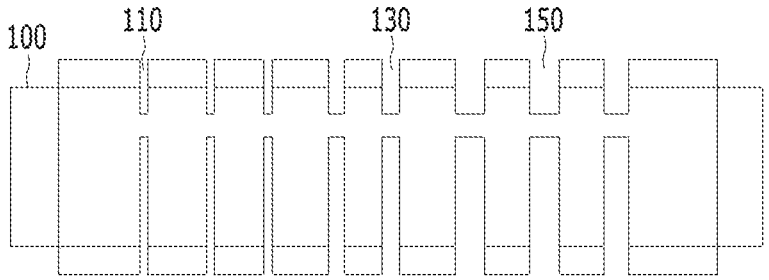
FIGS. 10A to 10C show resonators according to other embodiments of the present invention.
Figure 10B:
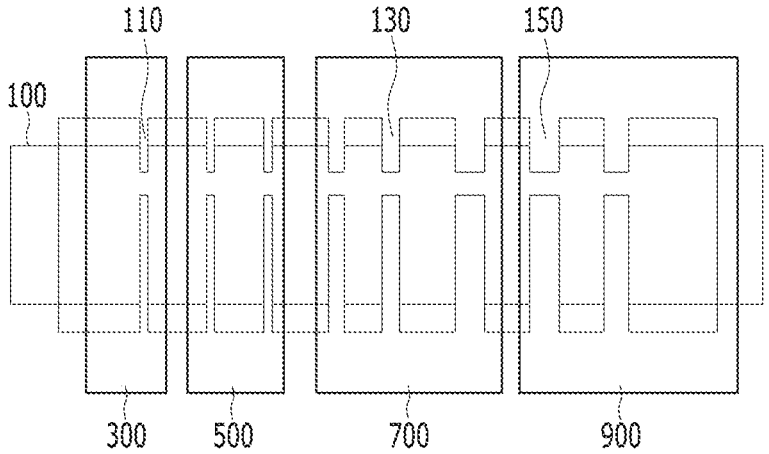
Figure 10C:
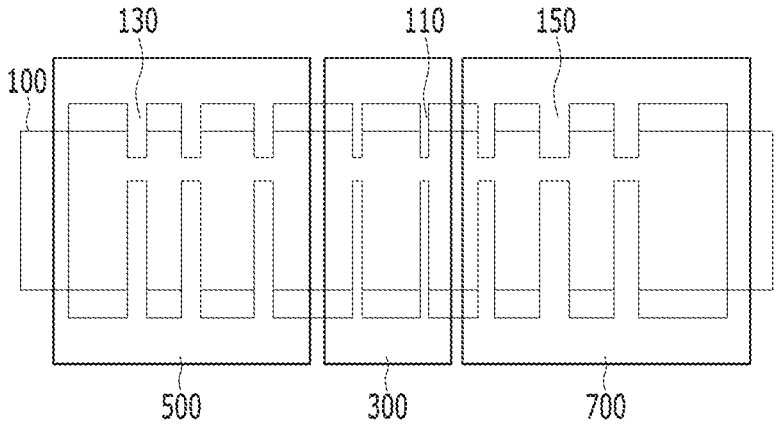

FIGS. 10A to 10C show resonators 10 according to other embodiments of the present invention.

The resonators 10 as shown in FIGS. 10A to 10C are similar to the resonators 10 as shown in FIGS. 2A to 3B except that a plurality of covers separated from each other are detachably coupled to the inner pipe 100, individually, and therefore, a repeated explanation on them will be avoided.

Referring to FIGS. 10A to 10C, the resonator 10 includes an inner pipe 100, a first cover 300, a second cover 500, a third cover 700, and a fourth cover 900.

The inner pipe 100 includes first openings 110, second openings 130, and third openings 150. Of course, the number of first to third openings, the circumferential lengths of the first to third openings, and the widths of the first to third openings in the longitudinal direction of the inner pipe 100 may be differently formed from each other. According to the present invention, further, the number of first openings 110, second openings 130, and third openings 150 is plural. Of course, the inner pipe 100 may include fourth openings.

As shown in FIG. 10B, the first cover 300, the second cover 500, the third cover 700, and the fourth cover 900 can be coupled sequentially to the inner pipe 100, and they can be spaced apart from each other. In this case, the intervals of the respective covers are smaller than the longitudinal widths of the respective covers. In detail, the first cover 300, the second cover 500, the third cover 700, and the fourth cover 900 can be coupled to the inner pipe 100 in such a manner as to be compactedly adjacent to each other.

The first cover 300 corresponds to the first openings 110, and the second cover 500 corresponds to other first openings 110, while corresponding to the number of first openings 110 different from the number of first openings 110 corresponding to the first cover 300.

The third cover 700 corresponds to the second openings 130 and the third opening 150.

The fourth cover 900 corresponds to other third openings 150.

The corresponding ways between the respective covers and the respective openings may be freely changed or combined if necessary.

According to the present invention, particularly, the first cover 300, the second cover 500, the third cover 700, and the fourth cover 900 can be coupled individually to the inner pipe 100. If necessary, accordingly, the coupling order of the first cover 300, the second cover 500, the third cover 700, and the fourth cover 900 may be changed as shown in FIG. 10C, and in this case, the positions of the openings of the inner pipe 100 may be changed correspondingly to the coupling positions of the respective covers.

Like this, the sizes of the first cover 300, the second cover 500, the third cover 700, and the fourth cover 900 are different from each other, and further, the number, sizes, and shapes of openings corresponding to the respective covers may be different from each other, thereby designing the resonators 10 having various target resonant frequencies.

Figure 11A:
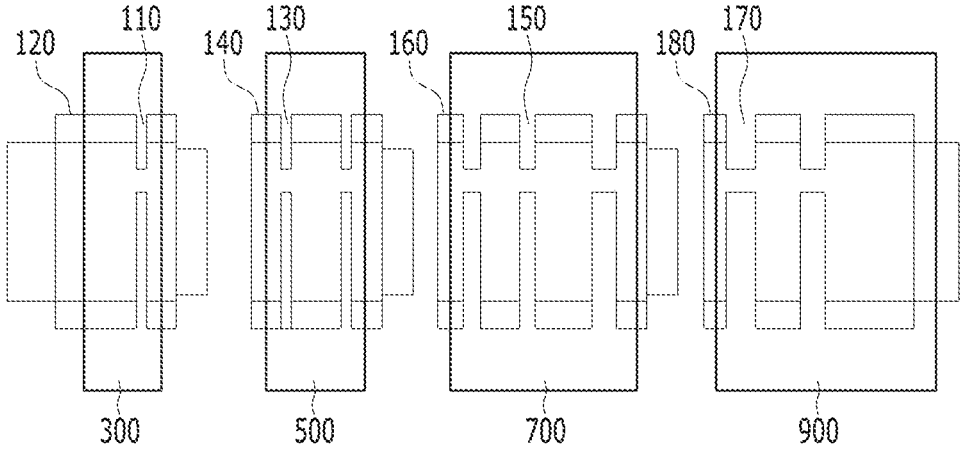
FIGS. 11A to 11C show resonators according to other embodiments of the present invention.
Figure 11B:
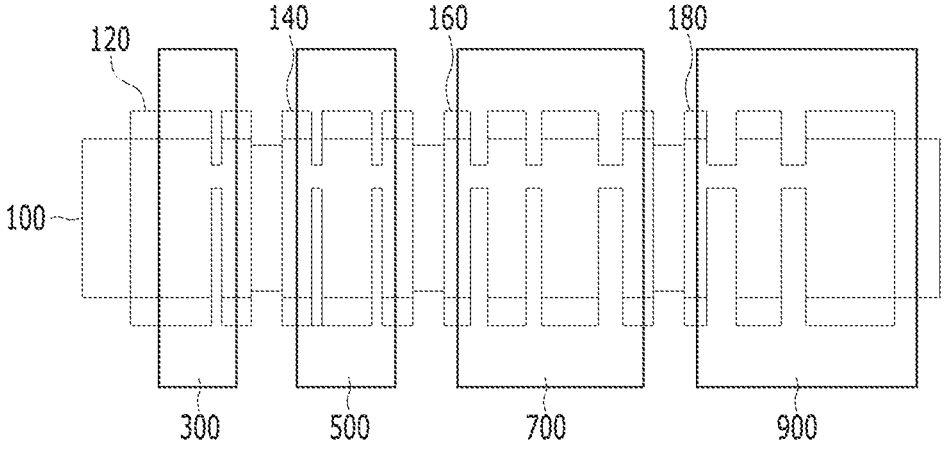
Figure 11C:
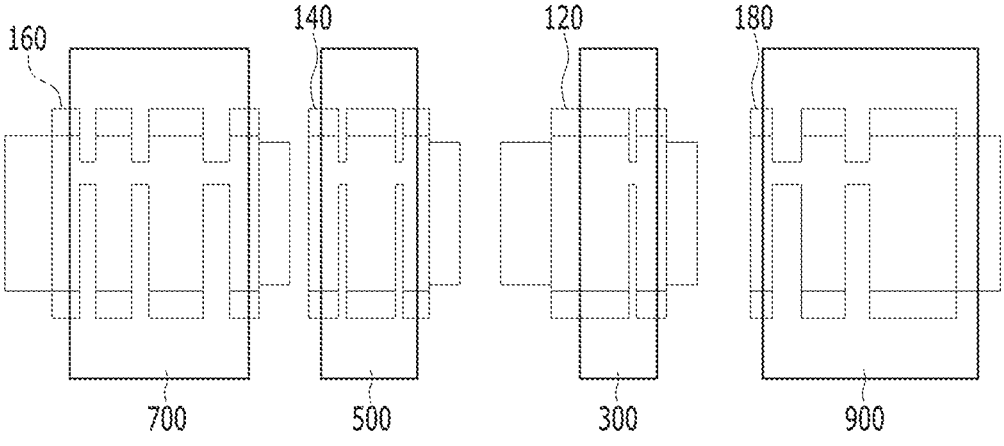

FIGS. 11A to 11C show resonators 10 according to other embodiments of the present invention.

The resonators 10 as shown in FIGS. 11A to 11C are similar to the resonators 10 as shown in FIGS. 10A to 10C except that an inner pipe 100 is formed of a body made by coupling a plurality of pipe parts, and therefore, a repeated explanation on them will be avoided.

Referring to FIGS. 11A to 11C, the resonator 10 includes an inner pipe 100, a first cover 300, a second cover 500, a third cover 700, and a fourth cover 900.

The inner pipe 100 includes a first pipe part 120, a second pipe part 140, a third pipe part 160, and a fourth pipe part 180.

As shown in FIG. 11A, the first pipe part 120 is insertedly fitted to the first cover 300, the second pipe part 140 to the second cover 500, the third pipe part 160 to the third cover 700, and the fourth pipe part 180 to the fourth cover 900.

Screw threads are formed on both end peripheries of the respective pipe parts so that the respective pipe parts can be sequentially coupled to each other, and as shown in FIG. 11B, accordingly, the inner pipe 100 is provided in such a manner as to allow the first cover 300, the second cover 500, the third cover 700, and the fourth cover 900 to be mounted thereon.

If necessary, also, their coupling order may be varied. In detail, as shown in FIG. 11C, the third pipe part 160, the second pipe part 140, the first pipe part 120, and the fourth pipe part 180 may be coupled sequentially to each other in the order mentioned, and the third cover 700, the second cover 500, the first cover 300, and the fourth cover 900 may be located in the order mentioned in such a manner as to correspond to the third pipe part 160, the second pipe part 140, the first pipe part 120, and the fourth pipe part 180.

Accordingly, a plurality of resonator modules as coupling bodies of the pipe parts and the covers is coupled to each other to provide the resonator customized to a specific specification.

In detail, the resonator modules are selected correspondingly to the number of resonant frequency peaks and frequencies as required, and then, the selected resonator modules are coupled to each other, thereby making one resonator.

Accordingly, the resonator according to the present invention is capable of providing various resonant frequencies in a wide band and being compact in structure and easy and convenient in combination.

As described above, the resonator according to the present invention can be customized to a plurality of target resonant frequencies through adjustment in volumes of the resonant spaces caused by changes in sizes or shapes of the opening formed on the inner pipe and changes in sizes of the covers.

In addition, the resonator according to the present invention can easily design and change the adjustment and combination of the openings and the covers to provide a plurality of target resonant frequencies and can be compacted in structure.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof. The present invention may be modified in various ways and may have several exemplary embodiments. For example, the parts expressed in a singular form may be dispersedly provided, and in the same manner as above, the parts dispersed may be combined with each other.

The scope of the invention is defined by the claims as will be discussed later, and it should be understood that the meaning and scope of the claims and the equivalents thereof are within the idea and technical scope of the invention.

What is claimed is:

1. A resonator configured to be mounted on an intake system of a vehicle for supplying air to an engine of the vehicle to allow a given frequency in intake noise to be resonated to reduce the intake noise, the resonator comprising:

an inner pipe having a shape of a cylinder with an inner peripheral surface forming an internal space and an outer peripheral surface and having first openings penetrated into the outer peripheral surface thereof from the inner peripheral surface thereof and second openings spaced apart from the first openings;

a first cover coupled to the outer peripheral surface of the inner pipe, such that a first resonant space is formed between the outer peripheral surface of the inner pipe and an inner peripheral surface of the first cover, the first resonant space communicating with the internal space of the inner pipe through the first openings and a volume of the first resonant space being set to reduce a first frequency; and a second cover coupled to the outer peripheral surface of the inner pipe, such that a second resonant space is formed between the outer peripheral surface of the inner pipe and an inner peripheral surface of the second cover, the second resonant space communicating with the internal space of the inner pipe through the second openings, and a volume of the second resonant space being set to reduce a second frequency, wherein the first cover and the second cover are connected unitarily with each other along the outer peripheral surface of the inner pipe in a circumferential direction of the inner pipe to have a shape of a loop that is spaced apart from the inner pipe, and the first cover and the second cover are divided by partition walls that are extended in a radial direction from the outer peripheral surface of the inner pipe to the inner peripheral surfaces of the first cover and the second cover, the partition walls being arranged apart from each other in the circumferential direction of the inner pipe.

2. The resonator according to claim 1, wherein one side peripheral end of the inner pipe communicates with a first pipe of the intake system for introducing external air, and another side peripheral end thereof communicates with a second pipe for supplying the external air to the engine.

3. The resonator according to claim 2, wherein the first openings and the second openings respectively have a shape of a slit extended in the circumferential direction of the inner pipe, and the first openings and the second openings are formed to allow at least one of the number of openings, lengths of openings in the circumferential direction of the inner pipe, widths of openings in a longitudinal direction of the inner pipe to be different from each other.

4. The resonator according to claim 2, further comprising a third cover spaced apart from the second cover in a longitudinal direction of the inner pipe and coupled to the outer peripheral surface of the inner pipe, such that a third resonant space is formed between the outer peripheral surface of the inner pipe and an inner peripheral surface of the third cover, the third resonant space communicating with the internal space of the inner pipe through third openings formed on the inner pipe, and a volume of the third resonant space being set to reduce a third frequency.

5. The resonator according to claim 4, wherein the first cover, the second cover, and the third cover are detachably coupled to the inner pipe, individually.

6. The resonator according to claim 5, wherein the inner pipe comprises:

a first pipe part insertedly fitted to the first cover;

a second pipe part insertedly fitted to the second cover; and a third pipe part insertedly fitted to the third cover.

* * * * *